US011691431B2

(12) United States Patent
Choy et al.

(10) Patent No.: US 11,691,431 B2
(45) Date of Patent: Jul. 4, 2023

(54) FLUID CIRCULATION AND EJECTION

(71) Applicant: Hewlett-Packard Development Company, L.P., Spring, TX (US)

(72) Inventors: Si-lam Choy, Corvallis, OR (US); Michael W. Cumbie, Corvallis, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/699,050

(22) Filed: Mar. 18, 2022

(65) Prior Publication Data

US 2022/0203696 A1 Jun. 30, 2022

Related U.S. Application Data

(63) Continuation of application No. 16/761,273, filed as application No. PCT/US2017/064380 on Dec. 2, 2017, now Pat. No. 11,292,265.

(51) Int. Cl.
*B41J 2/18* (2006.01)
*B41J 2/14* (2006.01)

(52) U.S. Cl.
CPC ..... *B41J 2/18* (2013.01); *B41J 2/14145* (2013.01); *B41J 2202/12* (2013.01)

(58) Field of Classification Search
CPC ..... B41J 2/14145; B41J 2/18; B41J 2002/14346; B41J 2202/12
See application file for complete search history.

(56) References Cited

U.S. PATENT DOCUMENTS

| | | | | |
|---|---|---|---|---|
| 5,818,485 | A | 10/1998 | Rezanka | |
| 8,157,365 | B2 | 4/2012 | Wouters et al. | |
| 8,182,073 | B2 | 5/2012 | Xie | |
| 8,292,385 | B2 | 10/2012 | Bracke et al. | |
| 8,439,481 | B2 | 5/2013 | Xie et al. | |
| 8,444,259 | B2 | 5/2013 | Bennett | |
| 8,517,518 | B2 | 8/2013 | Sasagawa et al. | |
| 8,608,300 | B2 | 12/2013 | Igawa et al. | |
| 8,820,904 | B2 | 9/2014 | Aldrich | |
| 8,851,639 | B2 * | 10/2014 | Arimoto | B41J 2/18 347/85 |
| 8,926,077 | B2 | 1/2015 | LaCaze et al. | |
| 9,694,582 | B1 | 7/2017 | Stephens et al. | |

(Continued)

FOREIGN PATENT DOCUMENTS

| | | |
|---|---|---|
| EP | 1052099 | 11/2000 |
| EP | 2414162 | 2/2012 |

(Continued)

OTHER PUBLICATIONS

The Sample Delivery of New 600 Dpi Ink Recirculating Inkjet Printhead "cf3" Has Started, Jul. 15, 2016, https://www.toshibatec.com/information/20160715_01.html.

*Primary Examiner* — Anh T Vo
(74) *Attorney, Agent, or Firm* — Foley & Lardner LLP

(57) ABSTRACT

A fluid circulation and ejection system may include a microfluidic die, a single orifice fluid ejector having a drive chamber in the microfluidic die and a pressurized fluid source remote from the microfluidic die to create a pressure gradient across the drive chamber to circulate fluid across the drive chamber.

8 Claims, 4 Drawing Sheets

(56) References Cited

U.S. PATENT DOCUMENTS

| | | | | |
|---|---|---|---|---|
| 9,724,926 | B2 | 8/2017 | Keefe et al. | |
| 2012/0160925 | A1 | 6/2012 | Hoisington et al. | |
| 2015/0124019 | A1* | 5/2015 | Cruz-Uribe | B41J 29/393 347/18 |
| 2016/0001568 | A1 | 1/2016 | Kamei | |

FOREIGN PATENT DOCUMENTS

| | | |
|---|---|---|
| EP | 2738007 | 6/2014 |
| EP | 3196027 | 7/2017 |
| JP | 2009143168 | 7/2009 |
| JP | 2014510649 | 5/2014 |
| JP | 2014522755 | 9/2014 |
| JP | 2017124620 | 7/2017 |
| WO | WO-2003052428 | 6/2003 |
| WO | WO-2013032471 | 3/2013 |
| WO | WO-2014098855 | 6/2014 |

* cited by examiner

FLUID CIRCULATION AND EJECTION

CROSS-REFERENCE TO RELATED APPLICATIONS

The present application is a continuation of co-pending U.S. application Ser. No. 16/761,273, filed May 4, 2020, which itself is a 371 patent application from PCT/US2017/064380 filed on Dec. 2, 2017, the full disclosures of which are hereby incorporated by reference.

BACKGROUND

Fluid ejectors are used to selectively dispense relatively small volumes of fluid. Many fluid ejectors utilize a fluid actuator that displaces fluid through a nozzle orifice. In some applications, the fluid is supplied from the cartridge. In other applications, the fluid is supplied from a remote source.

Figure 1:
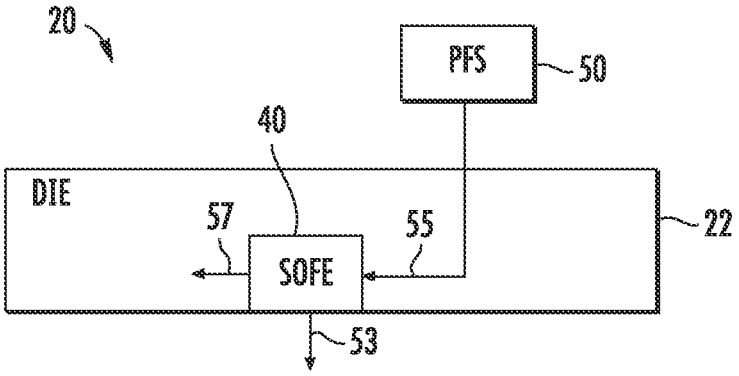
FIG. 1 is a schematic diagram illustrating portions of an example fluid circulation and ejection system.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Many fluids dispensed by fluid ejectors contain particles or pigments that have the tendency to settle. The settling of such particles or pigments may lead to reduced fluid ejector performance. For example, pigment settling and decap are challenges for the printing of high solid inks such as water-based UV ink.

Disclosed herein are example fluid circulation and ejection systems that circulate the fluid through and across a drive chamber of a fluid ejector to reduce settling of the particles or pigments. The example fluid circulation and ejection systems circulate the fluid across individual or single orifice fluid ejectors. The single orifice fluid ejectors have a single nozzle opening or orifice extending from the drive chamber, reducing stagnant areas where particles or pigments may settle. The example fluid circulation and ejection systems circulate the fluid across the single orifice fluid ejectors by creating a pressure gradient across the single orifice and across the drive chamber using a source of pressurized fluid that is remote from the microfluidic die or die supporting the fluid ejector. With respect to the source of pressurized fluid and the microfluidic die, the term "remote" means that the pump or other driving mechanism of the source of pressurized fluid is not carried or located on the microfluidic die 22 itself such that any heat produced by the pump is isolated from microfluidic die 22. The pressurized fluid produced by the remote pressurized fluid source is directed via a tube or other channel to the microfluidic die. Because the source of pressurized fluid is remote from the microfluidic die supporting the fluid ejector, the source of pressurized fluid does not heat the microfluidic die and the fluid being ejected, reducing ejection or printing defects that might otherwise result from the heat.

Disclosed herein are example fluid circulation and ejection systems that circulate the fluid from a fluid supply channel, across the single orifice fluid ejector, to a fluid discharge channel. The fluid discharge channel directs fluid that has been circulated across the drive chamber away from the drive chamber. The fluid supply channel and the fluid discharge channel are isolated from one another in regions of the microfluidic die adjacent the drive chamber. In implementations where the fluid ejectors utilize fluid actuators in the form of thermal resistors that generate heat to eject fluid, the fluid that is not ejected but that is heated by the thermal resistors is not allowed to substantially mix with freshly supplied fluid. The fresh unheated fluid being supplied to the drive chamber and the fluid ejector assists in transferring excess heat from the fluid ejector to maintain a more uniform temperature adjacent the fluid ejector to reduce heat induced printing or fluid ejection defects.

Some example systems have microfluidic dies comprising microfluidic channels. Microfluidic channels may be formed by performing etching, microfabrication (e.g., photolithography), micromachining processes, or any combination thereof in a microfluidic die of the fluidic die. Some example microfluidic dies may include silicon based microfluidic dies, glass based microfluidic dies, gallium arsenide based microfluidic dies, and/or other such suitable types of microfluidic dies for microfabricated devices and structures. Accordingly, microfluidic channels, chambers, orifices, and/or other such features may be defined by surfaces fabricated in the microfluidic die of a fluidic die. Furthermore, as used herein a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.).

Disclosed herein is an example fluid circulation and ejection system that comprises a microfluidic die, a single orifice fluid ejector having a drive chamber in the microfluidic die and a pressurized fluid source remote from the microfluidic die to create a pressure gradient across the drive chamber to circulate fluid across the drive chamber.

Disclosed herein is an example fluid circulation and ejection system that may comprise a microfluidic die comprising a fluid supply passage and a fluid discharge passage, a fluid supply channel extending from the fluid supply passage perpendicular to the fluid supply passage, a fluid discharge channel extending from the fluid discharge passage perpendicular to the fluid discharge passage and parallel to the fluid supply channel and fluid ejectors between the fluid supply channel and the fluid discharge channel. Each of the fluid ejectors may comprise a fluid actuator and a drive chamber adjacent the fluid actuator. The drive chamber may comprise a single orifice through which fluid is ejected by the fluid actuator, a fluid inlet connected to the fluid supply passage and a fluid outlet connected to the fluid discharge passage. The system may further comprise a fluid source remote from the microfluidic die to supply pressurized fluid to the fluid supply passage to create a pressure differential across the drive chamber to circulate fluid across the drive chamber.

Disclosed herein is an example method for supplying fluid to a fluid ejector. The method may comprise supplying fluid under pressure to a single orifice fluid ejector on a microfluidic die with a source of pressurized fluid remote from the microfluidic die. The method may further comprise maintaining a pressure differential across a drive chamber of the single orifice fluid ejector with the fluid supplied by the source of pressurized fluid to circulate fluid across the drive chamber.

FIG. 1 schematically illustrates portions of an example fluid circulation and ejection system 20. System 20 provides enhanced fluid ejection performance by circulating fresh, cool fluid through a single orifice fluid ejector to reduce particle settling and to reduce excessive heat buildup. System 20 provides an architecture that facilitates an enhanced pressure gradient across the drive chamber of the single orifice fluid ejector to reduce particle settling. System 20 utilizes a fluid pump or other source of pressurized fluid that is remote from the microfluidic die supporting the fluid ejectors such that the source of pressurized fluid does not, itself, introduce additional heat to the microfluidic die. System 20 comprises microfluidic die 22, single orifice fluid ejector (SOFE) 40 and pressurized fluid source (PFS) 50.

Microfluidic die 22 supports ejector 40. Microfluidic die 22 includes microfluidic channels or passages by which fluid is directed to single orifice fluid ejector 40. Microfluidic die 22 may further support electrically conductive wires or traces by which power and control signals are transmitted to ejector 40. In one implementation, microfluidic die 22 comprises a substrate which supports additional layers that form the firing chamber and nozzle opening of the fluid ejector. In one implementation, the substrate may be formed from silicon while the other layers are formed from other materials, such as photo resists and the like. In other implementations, the substrate and the other layers may be formed from other materials, such as polymers, ceramics, glass and the like.

Single orifice fluid ejector 40 ejects controlled volumes of fluid, such as droplets as indicated by arrow 53. Single orifice fluid ejector 40 has a firing chamber and a single orifice or opening extending from the firing chamber and through which fluid droplets are ejected. Because the firing chamber supplies fluid to a single orifice or nozzle, the dimensions of the firing chamber may be reduced to provide enhanced fluid flow velocity across the drive chamber to reduce particle settling.

The single orifice fluid ejector 40 may comprise a fluid actuator that displaces fluid. In one implementation, fluid actuator may comprise a thermal resistor based actuator, wherein electrical current flowing through the resistor produces sufficient heat to vaporize adjacent fluid so as to create an expanding bubble that displaces fluid through the orifice. In other implementations, the fluid actuator may include a piezoelectric membrane based actuator, an electrostatic membrane actuator, a mechanical/impact driven membrane actuator, a magneto-strictive drive actuator, or other such elements that may cause displacement of fluid responsive to electrical actuation.

Pressurized fluid source 50 comprises a source of pressurized fluid fluidly coupled to ejector 40, but remote from microfluidic die 22. The term "fluidly coupled" shall mean that two or more fluid transmitting volumes are connected directly to one another or are connected to one another by intermediate volumes or spaces such that fluid may flow from one volume into the other volume. Pressurized fluid source 50 creates a pressure gradient across the drive chamber of fluid ejector 40 such that the fluid supplied by pressurized fluid source 50 is circulated through and across the drive chamber (as indicated by arrows 55 and 57), reducing particle settling and transferring excess heat away from fluid ejector 40. The fluid discharged away from fluid ejector 40 is not permitted to remix with the fluid entering fluid ejector 40 proximate to fluid ejector 40. As a result, any heat introduced by fluid ejector 40 is transferred away from fluid ejector 40. In addition, because pressurized fluid source 50 is remote from microfluidic die 22, pressurized fluid source 50 does not introduce additional heat to microfluidic die 22 or fluid ejector 40. As a result, fluid ejection errors caused by non-uniform or excessive temperature of the fluid within the drive chamber of ejector 40 may be reduced.

Figure 2:
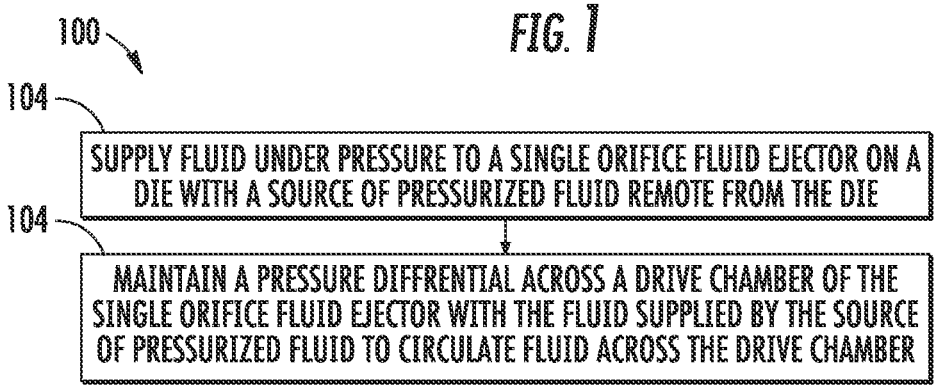
FIG. 2 is a flow diagram of an example method for supplying fluid to and circulating fluid with respect to a fluid ejector.

FIG. 2 is a flow diagram of an example method 100 for supplying fluid to a fluid ejector. Method 100 maintains a pressure differential or gradient across the drive chamber of a single orifice fluid ejector to circulate fluid across the drive chamber, reducing settling and transferring excess heat away from the drive chamber. Method 100 creates a pressure differential with a source of pressurized fluid remote from the microfluidic die to further reduce heating of the fluid within the drive chamber. Although method 100 is described as being carried out with fluid circulation and ejection system 20 described above, it should be appreciated that method 100 may be carried out with any of the systems described hereafter or with other similar fluid ejection and circulation systems.

As indicated by block 104, fluid under pressure is supplied to a single orifice fluid ejector on a die, such as die 22, with a source of pressurized fluid, such as pressurized fluid source 50, remote from the die. As indicated by block 108, a pressure differential is maintained across a drive chamber of the single orifice fluid ejector with the fluid supplied by the source of pressurized fluid. The pressure differential causes fluid to circulate across the drive chamber to inhibit particle settling and to transfer heat away from the drive chamber. In one implementation, the pressure differential created across the drive chamber is at least 0.1 inch we (inches water column).

Figure 3:
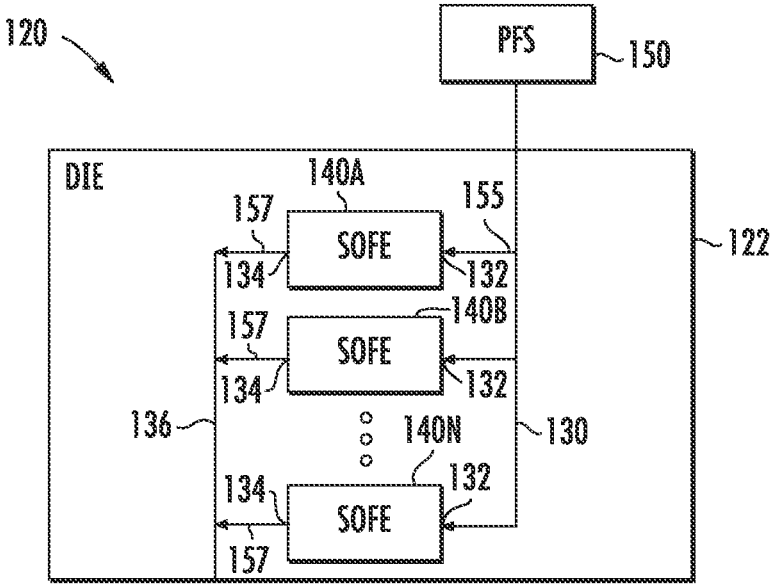
FIG. 3 is a schematic diagram illustrating portions of an example fluid circulation and ejection system.

FIG. 3 is a schematic diagram illustrating portions of an example fluid circulation and ejection system 120. System 120 comprises microfluidic die 122, single orifice fluid ejectors 140A-140N (collectively referred to as fluid ejectors 40) and pressurized fluid source 150. Microfluidic die 122 is similar to microfluidic die 22 described above except that microfluidic die 122 is specifically illustrated as supporting a plurality of single orifice fluid ejectors 140.

Single orifice fluid ejectors 140 are each similar to single orifice fluid ejector 40 described above. Each fluid ejector 140 ejects controlled volumes of fluid, such as droplets. Each single orifice fluid ejector 140 has a firing chamber and a single orifice or opening extending from the firing chamber and through which fluid droplets are ejected. Because the firing chamber supplies fluid to a single orifice or nozzle, the dimensions of the firing chamber may be reduced to provide enhanced fluid flow velocity across the drive chamber to reduce particle settling.

Each single orifice fluid ejector 140 may comprise a fluid actuator that displaces fluid. In one implementation, fluid actuator may comprise a thermal resistor based actuator, wherein electrical current flowing through the resistor produces sufficient heat to vaporize adjacent fluid so as to create an expanding bubble that displaces fluid through the orifice. In other implementations, the fluid actuator may include a piezoelectric membrane based actuator, an electrostatic membrane actuator, a mechanical/impact driven membrane actuator, a magneto-strictive drive actuator, or other such elements that may cause displacement of fluid responsive to electrical actuation.

Pressurized fluid source 150 is similar to pressurized fluid source 50 described above. Pressurized fluid source 150 comprises a source of pressurized fluid fluidly coupled to each ejector 140, but remote from microfluidic die 122. Pressurized fluid source 150 creates a pressure gradient across the drive chamber of each individual fluid ejector 140 such that the fluid supplied by pressurized fluid source 150 is circulated through and across the drive chamber (as indicated by arrows 155 and 157), reducing particle settling and transferring excess heat away from fluid ejector 40. The fluid discharged away from each fluid ejector 140 is not permitted to remix with the fluid entering fluid ejector 140 proximate to fluid ejector 140. As a result, any heat introduced by fluid ejector 140 is transferred away from fluid ejector 140. In addition, because pressurized fluid source 150 is remote from microfluidic die 122, pressurized fluid source 150 does not introduce additional heat to microfluidic die 122 or fluid ejectors 140. As a result, fluid ejection errors caused by non-uniform temperature of the fluid within the drive chamber of ejector 140 may be reduced.

In the example illustrated, pressurized fluid source 150 supplies fluid under pressure to each of fluid ejectors 140 through a single fluid supply channel 130 which is connected to an inlet 132 of each of the fluid ejectors 140. Each fluid ejector 140 has an outlet 134 connected to a shared fluid discharge channel 136 which transfers the fluid away from fluid ejectors 140. In the example illustrated, fluid ejector 140 are arranged in a column, wherein fluid supply channel 130 and fluid discharge channel 136 extend on opposite sides of the column providing for a compact arrangement on microfluidic die 122. In other implementations, each of fluid ejectors 140 or groups of fluid ejectors 140 may have dedicated fluid supply passages and/or fluid discharge passages.

FIGS. 4-7 illustrate portions of another example fluid circulation and ejection system 220. As with systems 20 and 120, system 220 reduces particle settling by creating a pressure gradient across drive chambers of single orifice fluid ejectors to circulate fluid across the drive chambers. As with systems 20 and 120, system 220 provides a pressure gradient using a remote source of pressurized fluid that does not introduce heat to the microfluidic die. As with systems 20 and 120, system 220 utilizes isolated fluid supply and fluid discharge channels that inhibit mixing of the potentially heated fluid that has just exited the drive chamber. System 220 comprises microfluidic die 222 supporting a plurality of single orifice fluid ejectors 240 which are supplied with a pressurized fluid from a pressurized fluid source 250.

Microfluidic die 222 comprises substrate 224, adhesive layer 226, interposer layer 228, chamber layer 230 and orifice layer 232 which form fluid supply slot 234 fluid supply channel 236, drive chambers 238 of fluid ejectors 240, fluid discharge channel 242, fluid discharge slot 244 and bypass channel 256. Substrate 224 comprises a layer of material in which fluid supply slot 234 and fluid discharge slot 236 are formed. In one implementation, substrate 224 comprises a layer of silicon. In other implementations, substrate 224 maybe form from other materials such as polymers, ceramics, glass and the like.

Adhesive layer 228 comprise a layer of adhesive material joining interposer layer 228 to substrate 224. In the example illustrated, adhesive layer 226 spaces interposer layer 228 from substrate 224 so as to form bypass channel 256. In one implementation, adhesive layer 228 comprises Epoxy adhesive. in other implementations, adhesive layer 228 may be formed from other materials or may be omitted.

Figure 4:
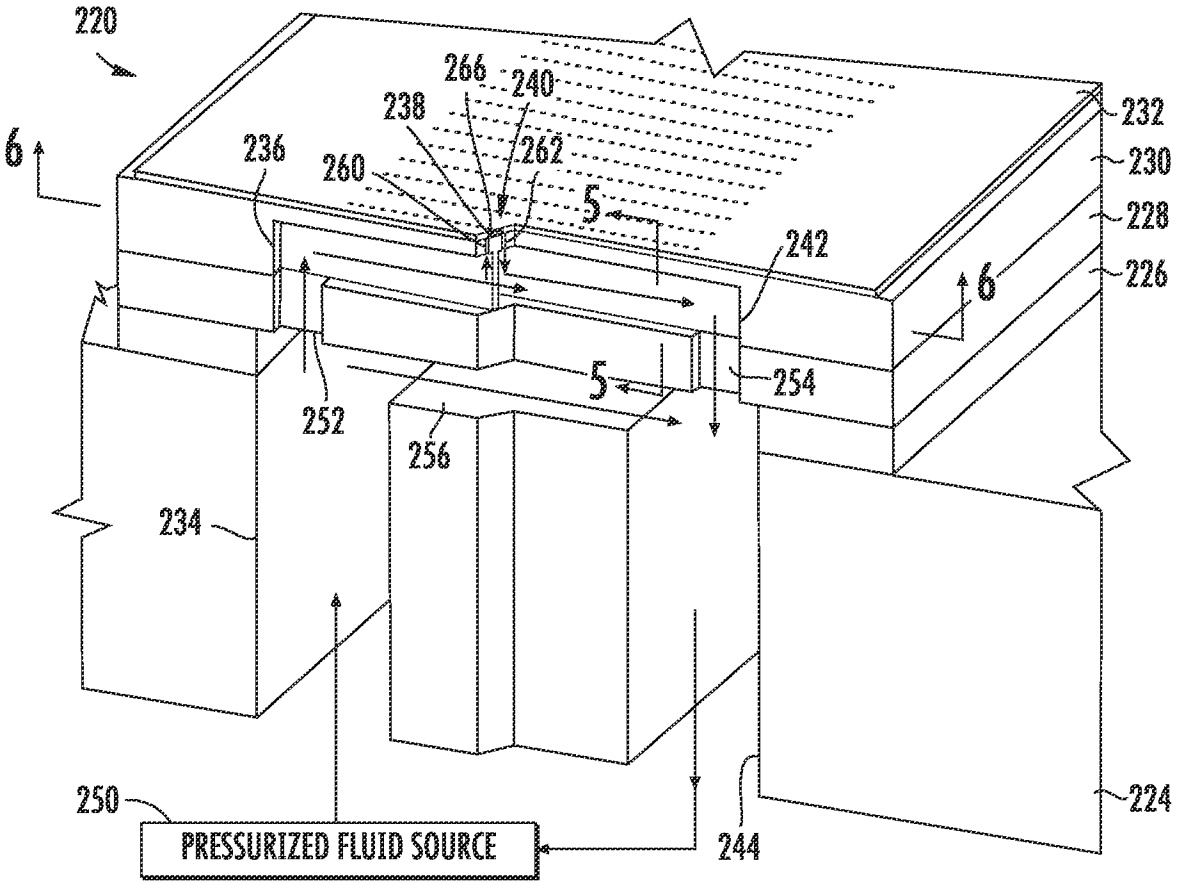
FIG. 4 is a sectional view of portions of an example fluid circulation and ejection system.

Interposer layer 230 comprise a layer of material extending between adhesive layer 226 and chamber layer 230. Interposer layer 228 forms an inlet 252 of fluid supply channel 236 connected to slot 234. Interposer layer 230 further forms an outlet 254 of fluid discharge channel 242 connected to discharge slot 244. Interposer layer 228 facilitates fabrication of channels 236 and 242, facilitating the formation of channel 236 and 242 with grooves formed in chamber layer 230, wherein layer 228 forms a floor of channels 236 and 242 (as seen in FIG. 4). In one implementation, interposer layer 228 is formed from silicon. In other implementations, interposer layer 228 may be formed from other materials such as polymers, ceramics, glass and the like.

Figure 5:
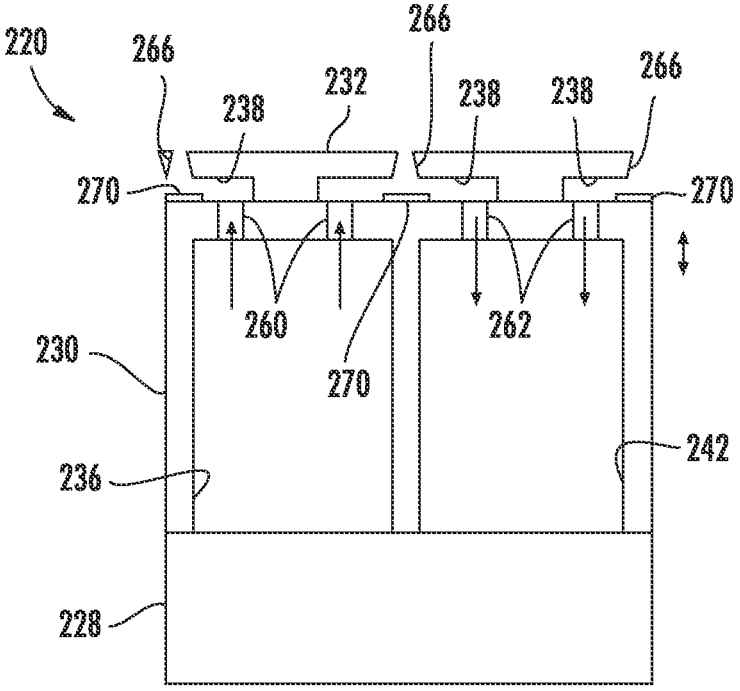
FIG. 5 is a sectional view of portions of the system of FIG. 4 taken along line 5-5.

Chamber layer 230 comprises a layer of material forming fluid supply channel 236, fluid discharge channel 242 and a ceiling or top of drive chamber 238 (when system 220 is ejecting fluid in a downward direction). FIG. 5 is a sectional view through a portion of system 220 illustrating chamber layer 230 and orifice layer 232 in more detail. As shown by FIG. 5, chamber layer 230 cooperates with interposer layer 228 to form fluid supply channel 236 and fluid discharge channel 242. Chamber layer 230 comprises openings 260 that extend through layer 230 opposite interposer 228. Each of openings 260 is located so as to form an inlet or feed hole of a partially overlying drive chamber 238. Likewise, chamber layer 230 comprises openings 262 that extend through layer 230 opposite interposer 228. Each of openings 262 is located to as to form an outlet or discharge hole of a partially overlying drive chamber 238.

Figure 6:
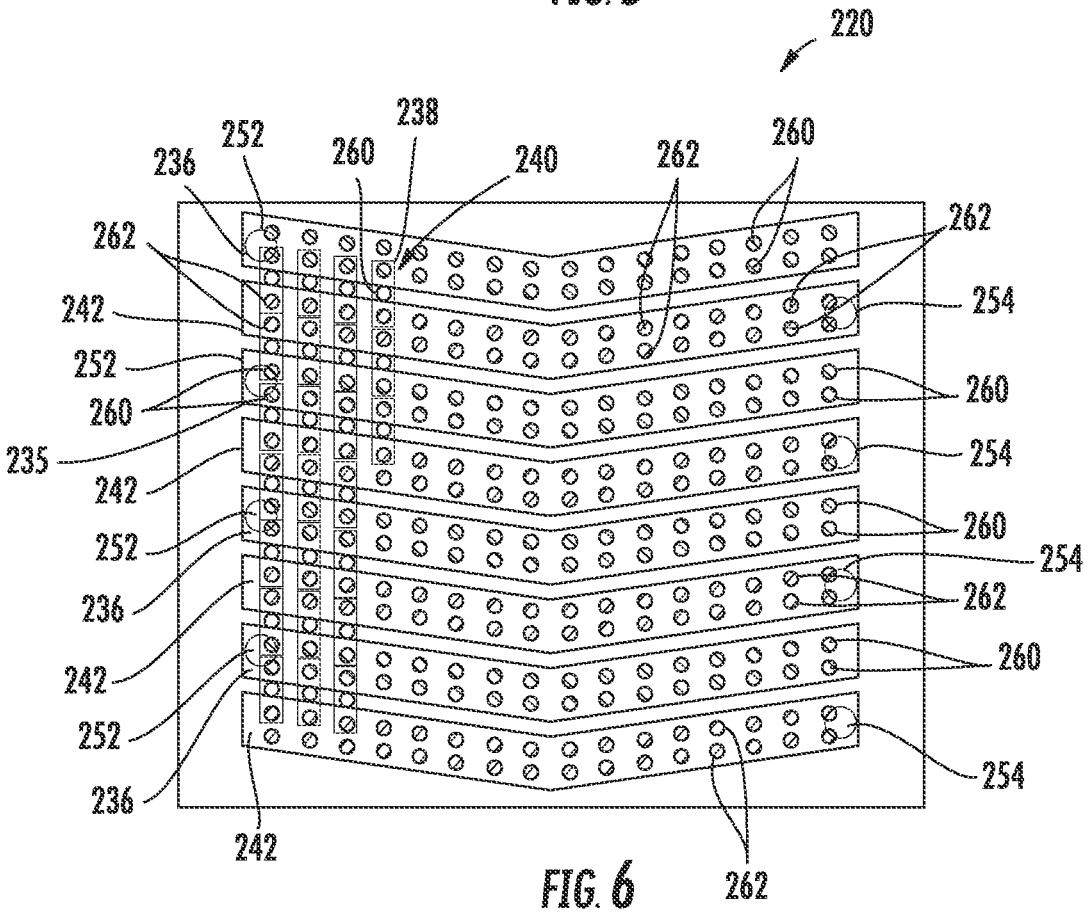
FIG. 6 is a sectional view of portions of the system of FIG. 4 taken along line 6-6.

FIG. 6 is a sectional view of system 220 taken along line 6-6 of FIG. 4. FIG. 6 illustrates an example layout of alternating fluid supply channels 236 and fluid discharge channels 238 which supply fluid to and which discharge fluid from a multitude of fluid ejectors 40 arranged in columns. As shown by FIG. 6, each fluid supply channel 236 comprises two rows of inlets 260. Each fluid discharge channel 242 comprises two rows of outlets 262. Each drive chamber 238 (some of which are schematically shown in FIG. 6 with a rectangle) bridges across adjacent or consecutive channels 236, 242 with the orifice 266 generally between the two channels 236, 242. The architecture shown in FIG. 6 allows a single fluid supply channel 236 to supply fluid to the inlets 260 of two columns of fluid ejectors 240 and to discharge fluid from the outlets 262 of two columns of fluid ejectors 240. As a result, the architecture provides a compact and efficient layout for providing isolated fluid supply channels and fluid discharge channels for each of the fluid ejectors 240.

As shown by FIGS. 4 and 5, orifice layer 232 comprise a layer of material deposited or formed upon chamber layer 230 and patterned so as to form the sides and floor of each firing chamber 238 and the single nozzle or orifice 266 of each ejector 238. Orifice layer 232 cooperates with chamber layer 230 to form each drive chamber 238. In one implementation, orifice layer 232 may comprise a photoresist epoxy material such as SU8 (a Bisphenol A Novolac epoxy that is dissolved in an organic solvent (gamma-butyrolactone GBL or cyclopentanone), facilitating patterning of layer 232 to form the floor and sides of each drive chamber 238 as well as the nozzle or orifice 266 of each fluid ejector 240. In yet other implementations, orifice layer 232 may be formed from other materials.

As shown by FIG. 5, each ejector 240 further comprises a fluid actuator 270 within each drive chamber 238, generally opposite to orifice 266. In the example illustrated, each fluid actuator 230 comprises a thermal resistor electrically connected to a source of electrical power and associated switches or transistors by which electric current is selectively supplied to the resistor to generate sufficient heat so as to vaporize adjacent liquid in form and expanding bubble that displaces and expels non-vaporized fluid through orifice 266. In other implementations, each fluid actuator 230 may comprise other forms of fluid actuators such as a piezoelectric membrane based actuator, an electrostatic membrane actuator, a mechanical/impact driven membrane actuator, a magneto-strictive drive actuator, or other such elements that may cause displacement of fluid responsive to electrical actuation.

Figure 7:
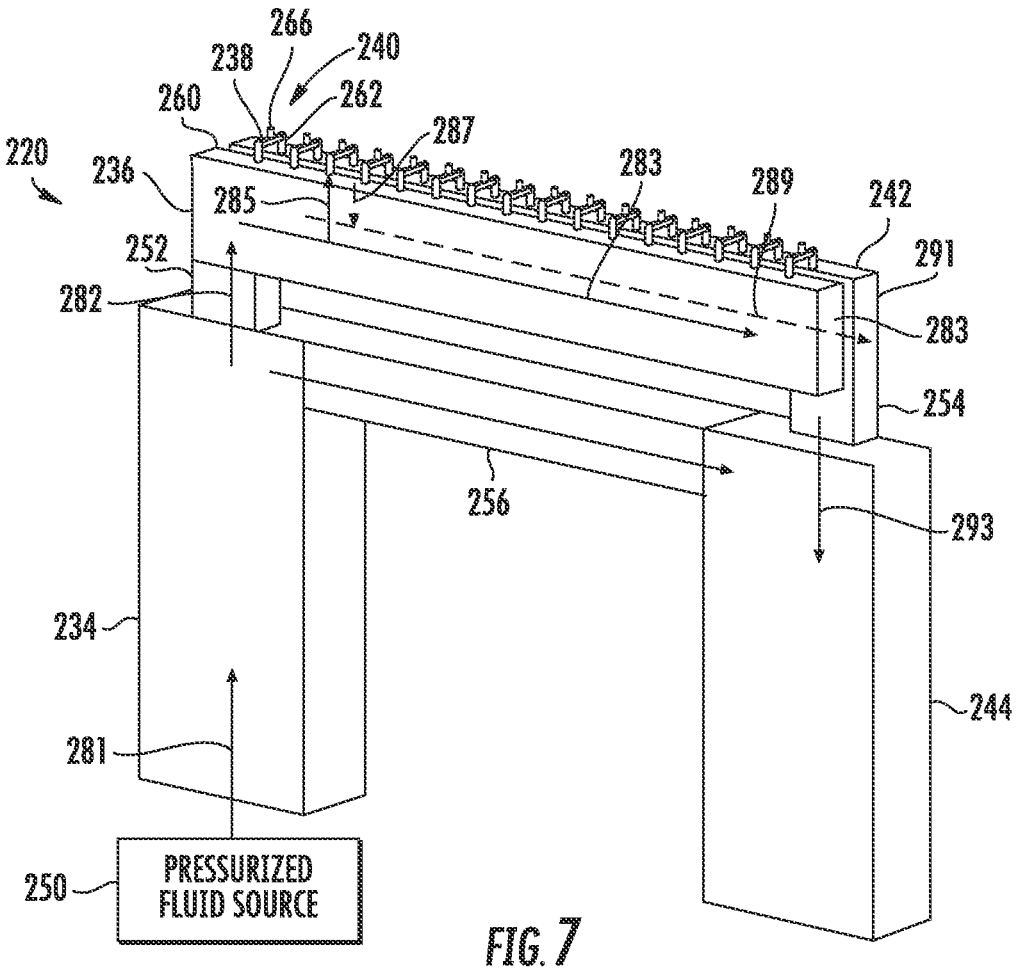
FIG. 7 is a perspective view illustrating the volumes through which fluid is circulated in the system of FIG. 4.
Figure 8:
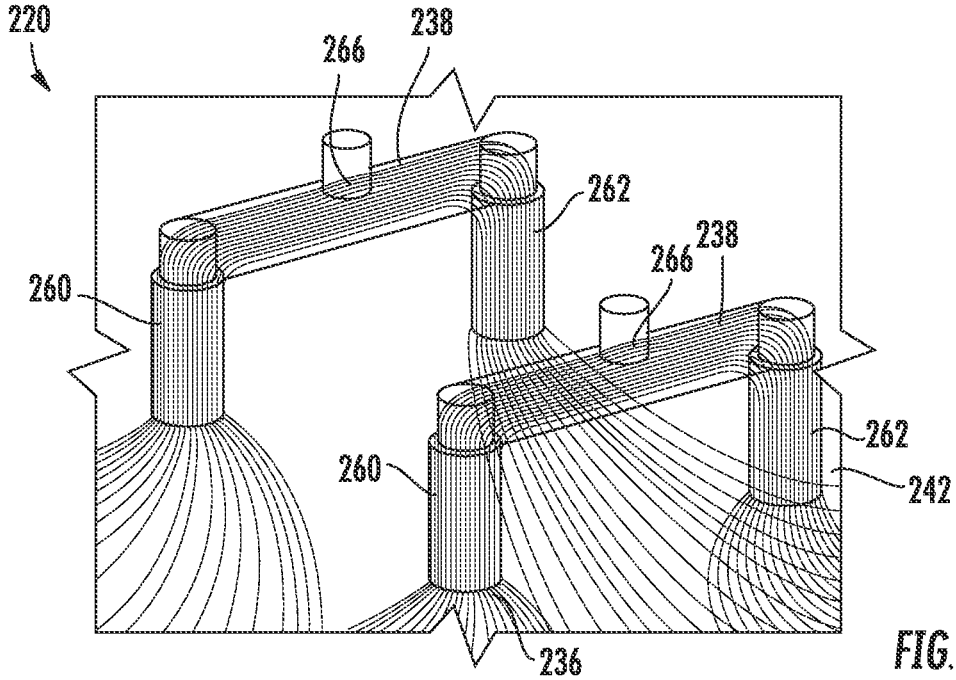
FIG. 8 is an enlarged perspective view of a portion of the system of FIG. 4 illustrating the circulation of fluid across drive chambers of fluid ejectors.

FIGS. 7 and 8 illustrate the circulation of fluid within system 220. FIG. 7 illustrates the general shape of the various conduits or volumes through which fluid flows in system 220. As shown by FIG. 7, pressurized fluid from pressurized fluid source 250, remote from microfluidic die 222 and remote from substrate 224, is supplied to slot 234 as indicated by arrow 281. The fluid passes through inlet 252 is indicated by arrow 282 and travels along microfluidic supply channel 236 as indicated by arrow 283, reaching the dead end 283 of channel 236, pressurizing channel 236. The pressurized fluid within supply channel 236 flows into the inlet 260 of each of fluid ejectors 240 as indicated by arrow 285. The fluid flows or circulated across each drive chamber 238, which is in the form of a thin elongate microfluidic passage or channel. The fluid not ejected through orifice 266 by the fluid actuator 270 (shown in FIG. 5) is discharged through outlet 262 into fluid discharge channel 242.

FIG. 8 illustrates the circulation of fluid through and across drive chambers 238 from fluid supply channel 236 to fluid discharge channel 242. As shown by FIG. 8, each fluid supply channel 236 has a first flow dimension (the cross-sectional area through which fluid may flow) while each drive chamber 238 and its associated fluid inlet 260 have a second flow dimension less than the first flow dimension. The flow dimensions of inlet 260 and drive chamber 238 in combination with the pressure gradient formed between supply channel 236 and discharge channel 242 a flow velocity through drive chamber 238 that effectively inhibits particle settling.

In one implementation, fluid supply channel 236 and fluid discharge channel 242 each have a width of between 100 um and 400 um, and nominally 275 μm and a height of between 200 um and 600 um, and nominally 300 μm. Each fluid feed hole inlet 260 and fluid discharge hole outlet 262 has a diameter of between 10 um and 50 um, and nominally 30 μm. Each inlet 260 and each outlet 262 has a height of between 10 um and 120 um, and nominally 50 μm. Each drive chamber 238, in the form of a microfluidic channel, has a height of between 10 um and 40 um, and nominally 17 μm, a width of between 10 um and 50 um, and nominally 20 μm and a length (from inlet 160 to outlet 162) of between 50 um and 500 um, and nominally micrometers. In the example illustrated, the drive chambers 238 and their respective nozzle orifices 266 have a pitch or are spaced apart from one another by at least 100 um and nominally 169 μm. Such dimensions provide a compact layout and arrangement of fluid ejectors 240 while providing adequate fluid flow velocities through and across drive chambers 238 to inhibit particle settling and transfer heat out of and away from each of the individual fluid ejectors 240.

As further shown by FIG. 7, fluid discharged through outlet 262 into fluid discharge channel 242, as indicated by arrow 287, travels along discharge channel 242, as indicated by arrow 289, until reaching the dead end 291 of channel 242, where the fluid passes through outlet 254 into fluid discharge slot 244, as indicated by arrow 293. In the example illustrated, the transfer of heat away from fluid ejector 240 is further facilitated by bypass channel 256. As shown by FIG. 4, bypass channel 256 extends between substrate 224 and interposer layer 228 which forms the floor of channel 236, 242. Bypass channel 256 provides a larger flow dimension by which fluid may be circulated across and behind each of the fluid ejectors 240 to carry away excess heat. Large circulating flow rate of fluid may facilitate a more uniform and constant temperature across the different fluid ejectors 240 for more reliable and consistent fluid ejection or printing performance.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A method comprising:

supplying fluid under pressure, via a fluid supply passage and a fluid supply channel extending from the fluid supply passage, to a single orifice fluid ejector on a microfluidic die with a pressurized fluid source remote from the microfluidic die, the single orifice fluid ejector having a thermal fluid actuator, a drive chamber, and a fluid discharge channel connecting the drive chamber to a fluid discharge passage in the microfluidic die;

maintaining a pressure gradient across a drive chamber of the single orifice fluid ejector to circulate fluid through the drive chamber, inhibit particle settling within the drive chamber, and transfer heat out of and away from the thermal fluid actuator and drive chamber; and directing fluid along a bypass channel directly connecting the fluid supply passage to the fluid discharge passage, the bypass channel extending across a back side of the fluid ejector to carry excess heat away from the fluid ejector, the bypass channel comprising a gap between a substrate of the microfluidic die and an interposer layer, wherein the interposer layer includes the fluid supply channel and the fluid discharge channel.

2. The method of claim 1, wherein the fluid supply channel has a first flow dimension in the microfluidic die, and wherein supplying fluid under pressure includes supplying fluid via a fluid inlet to the drive chamber having a second flow dimension less than the first flow dimension.

3. The method of claim 2, further comprising discharging fluid from the drive chamber through the fluid discharge channel connected to fluid outlet of the drive chamber.

4. The method of claim 1, further comprising:

supplying fluid under pressure to a second single orifice fluid ejector having a second thermal fluid actuator and a second drive chamber in the microfluidic die;

supplying fluid under pressure to a third single orifice fluid ejector having a third thermal fluid actuator and a third drive chamber in the microfluidic die;

wherein supplying fluid under pressure includes supplying fluid via a fluid supply channel connected to an inlet of each of the drive chamber, the second drive chamber and the third drive chamber, wherein the pressurized fluid source is connected to the fluid supply channel to create a pressure gradient across each of the drive chamber, the second drive chamber and the third drive chamber to:

circulate fluid across the drive chamber, the second drive chamber and the third drive chamber, inhibit particle settling within the drive chamber, the second drive chamber and the third drive chamber, and transfer heat out of and away from the thermal fluid actuator, the second thermal fluid actuator and the third thermal fluid actuator.

5. A method comprising:

supplying fluid under pressure via a fluid supply channel to a single orifice fluid ejector on a microfluidic die with a pressurized fluid source remote from the microfluidic die, the single orifice fluid ejector having a thermal fluid actuator and a drive chamber in the microfluidic die;

establishing a pressure gradient across a drive chamber of the single orifice fluid ejector to circulate fluid through the drive chamber and inhibit particle settling within the drive chamber; and discharging fluid from the drive chamber through a fluid discharge channel connected to fluid outlet of the drive chamber; and directing fluid along a bypass channel extending across a back side of the single orifice fluid ejector to carry excess heat away from the single orifice fluid ejector, the bypass channel comprising a gap between a substrate of the microfluidic die and an interposer layer, wherein the interposer layer includes the fluid supply channel and the fluid discharge channel.

6. The method of claim 5, wherein the fluid supply channel has a first flow dimension in the microfluidic die, and wherein supplying fluid under pressure includes supplying fluid via a fluid inlet to the drive chamber having a second flow dimension less than the first flow dimension.

7. The method of claim 6, further comprising bypassing the drive chamber by directing fluid from a fluid supply passage directly to a fluid discharge passage, the fluid supply passage feeding the fluid supply channel and the fluid discharge passage being fed by the fluid discharge channel.

8. A method comprising:

supplying fluid under pressure to fluid ejectors on a microfluidic die via a fluid supply passage and a fluid supply channel extending from the fluid supply passage, each fluid ejector having a drive chamber with a thermal fluid actuator, a fluid inlet with a first flow dimension connecting the fluid supply passage to the drive chamber, and a fluid outlet connecting the drive chamber to a fluid discharge channel, wherein the fluid supply channel has a second flow dimension greater than the first flow dimension;

establishing a pressure gradient across the drive chamber of each fluid ejector to circulate fluid through the drive chamber, inhibit particle settling within the drive chamber, and transfer heat out of and away from the thermal fluid actuator and drive chamber; and discharging fluid from the drive chamber via the fluid discharge channel and a fluid discharge passage extending from the fluid discharge channel; and directing fluid along a bypass channel directly connecting the fluid supply passage to the fluid discharge passage, the bypass channel extending across a back side of the fluid ejector to carry excess heat away from the fluid ejector, the bypass channel comprising a gap between a substrate of the microfluidic die and an interposer layer, wherein the interposer layer includes the fluid supply channel and the fluid discharge channel.

* * * * *